United States Patent [19]

Daniels et al.

[11] Patent Number: 5,055,008

[45] Date of Patent: Oct. 8, 1991

[54] PROPORTIONATING PUMP FOR LIQUID ADDITIVE METERING

[75] Inventors: Raymond R. Daniels, Belleair; Norman W. Scheid, Tarpon Springs; Donald C. Bryant, Palm Harbor, all of Fla.

[73] Assignee: Chemilizer Products, Inc., Clearwater, Fla.

[21] Appl. No.: 471,496

[22] Filed: Jan. 29, 1990

[51] Int. Cl.[5] ..... F04B 17/00

[52] U.S. Cl. ..... 417/403; 417/404; 417/528; 91/229; 91/346

[58] Field of Search ..... 417/375, 403, 404, 534, 417/535, 418, 486, 547, 528, 417; 91/224, 229, 346, 437

[56] References Cited

U.S. PATENT DOCUMENTS

| | | | |
|---|---|---|---|
| Re. 29,193 | 4/1977 | Carlyle | 137/99 |
| 400,428 | 4/1889 | Bagley | 417/528 |
| 1,065,225 | 6/1913 | Cunningham | 417/528 |
| 1,097,955 | 5/1914 | Wallinder | 417/528 |
| 2,408,075 | 9/1946 | Kowalsky, Jr. et al. | 91/224 |
| 2,446,748 | 8/1948 | Etter | 417/547 |
| 2,539,292 | 1/1951 | Anderson | 91/229 |
| 2,916,998 | 12/1959 | Miller | 137/99 |
| 3,114,379 | 12/1963 | Cordis | 137/99 |
| 3,175,512 | 3/1965 | Sutliff | 417/547 |
| 3,213,873 | 10/1965 | Cordis | 137/512.3 |
| 3,361,036 | 1/1968 | Harvey et al. | 91/229 |
| 3,374,746 | 3/1968 | Chenault | 417/528 |
| 3,380,467 | 4/1968 | Diehl, Jr. et al. | 417/404 |
| 3,699,846 | 10/1972 | Stomper | 91/346 |
| 3,700,359 | 10/1972 | Vanderjagt | 417/404 |
| 3,865,126 | 2/1975 | Baggaley | 137/99 |
| 3,921,501 | 11/1975 | Rosback | 91/437 |
| 3,945,772 | 3/1976 | Van de Modretele | 417/489 |
| 3,960,058 | 6/1976 | Berkelius | 91/229 |
| 3,963,038 | 6/1976 | Jensen | 137/99 |
| 3,999,896 | 12/1976 | Sebastiani | 417/404 |
| 4,004,602 | 1/1977 | Cordis et al. | 137/99 |
| 4,028,014 | 6/1977 | Cocks | 417/403 |
| 4,060,351 | 11/1977 | Cloup | 417/520 |
| 4,610,192 | 9/1986 | Hartley et al. | 91/346 |
| 4,738,600 | 4/1988 | Safford | 417/403 |
| 4,750,871 | 6/1988 | Curwen | 417/418 |
| 4,756,329 | 7/1988 | Cloup | 91/229 |
| 4,781,546 | 11/1988 | Curwen | 417/417 |

*Primary Examiner*—Richard A. Bertsch
*Assistant Examiner*—Michael I. Kocharov
*Attorney, Agent, or Firm*—Harold D. Shall

[57] ABSTRACT

A proportioning pump for liquid additive metering having a housing with a diaphragm piston therein and inlet and outlet primary fluid lines to said housing for moving said diaphragm piston up and down. Additive pistons for pumping an additive liquid into said primary fluid with said additive pistons being moved by said diaphragm piston.

2 Claims, 2 Drawing Sheets

PROPORTIONATING PUMP FOR LIQUID ADDITIVE METERING

BACKGROUND OF THE INVENTION

This invention relates to liquid metering apparatus generally and more particularly to an apparatus for supplying a liquid additive to a flow of liquid. The device according to this invention uses the flow of a liquid to enable a specific quality of additive to be injected into said liquid.

DESCRIPTION OF PRIOR ART

The prior art utilizes a reciprocating pump to inject an additive fluid into the main fluid that drives the reciprocating pump. However such pumps operate on only one-half of their reciprocating motion and contrary to the present device which injects like amounts of additive fluid on both the up stroke and downstroke of the reciprocating motion.

Prior art devices of the reciprocating pump type which are powered by a first fluid to power the additive fluid also are so structured so that upon failure of a part and loss of reciprocating movement blocks the flow of the first fluid so that if, for example, the device was being used as a poultry watering system, the blocked reciprocation would deprive the poultry of all water supply, whereas in the instant device, bypass valves become activiated which allows for continued flow of the primary fluid.

SUMMARY OF THE INVENTION

Flowing driving water enters the main pump and drives a water motor which in turn operates an additive pump which draws an additive liquid from a container and injects it into the flowing driving water as the later exits the pump. The additive pump and main pump are sized so as to give a certain ratio of additive liquid to the driving water.

The water motor comprises a housing having a diaphragm piston therein which is driven back and forth by diverting the flowing incoming driving water alternately from one side of the diaphragm piston to the other side thereof. The driving water is diverted from one side of the piston to the other side thereof by a system of inlet and outlet valves which are activiated instantaneously at the extremes of the piston stroke by an over-center spring mechanism.

When the incoming water drives the piston down, it forces water below the piston out of the pump through the outlet valves. When the piston reaches the bottom of its stroke, the over-center spring reacts and pulls the inlet and outlet valves up thus allowing incoming water into the bottom side of the piston. The piston is pushed up and water above the piston is pushed out of the outlet valves. When the piston reaches the top extreme of the stroke, the over-enter spring snaps in the opposite direction and pushes the inlet valves down again thus starting the cycle over again.

The additive pump consists of a double piston so as to inject an equal amount of additive fluid on the up and down stroke. The additive pump attaches to and is reciprocated by the up and down motion of the diaphragm piston and pumps one-half of the desired additive on the up stroke and one-half on the down stroke of the additive pump so that a continuous flow of additive fluid is pumped into the driving water at a location where it exits from the pump, so that the water within the driving pump is not contaminated.

DETAILED DESCRIPTION

Figure 1:
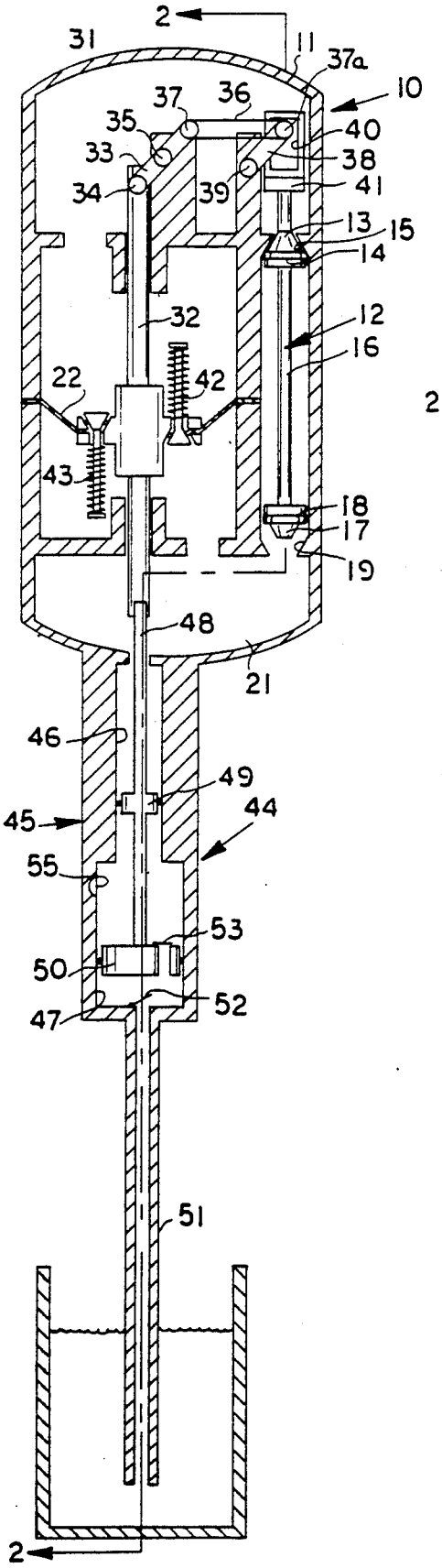
FIG. 1 is a view in longitudinal section of a device according to the invention.
Figure 2:
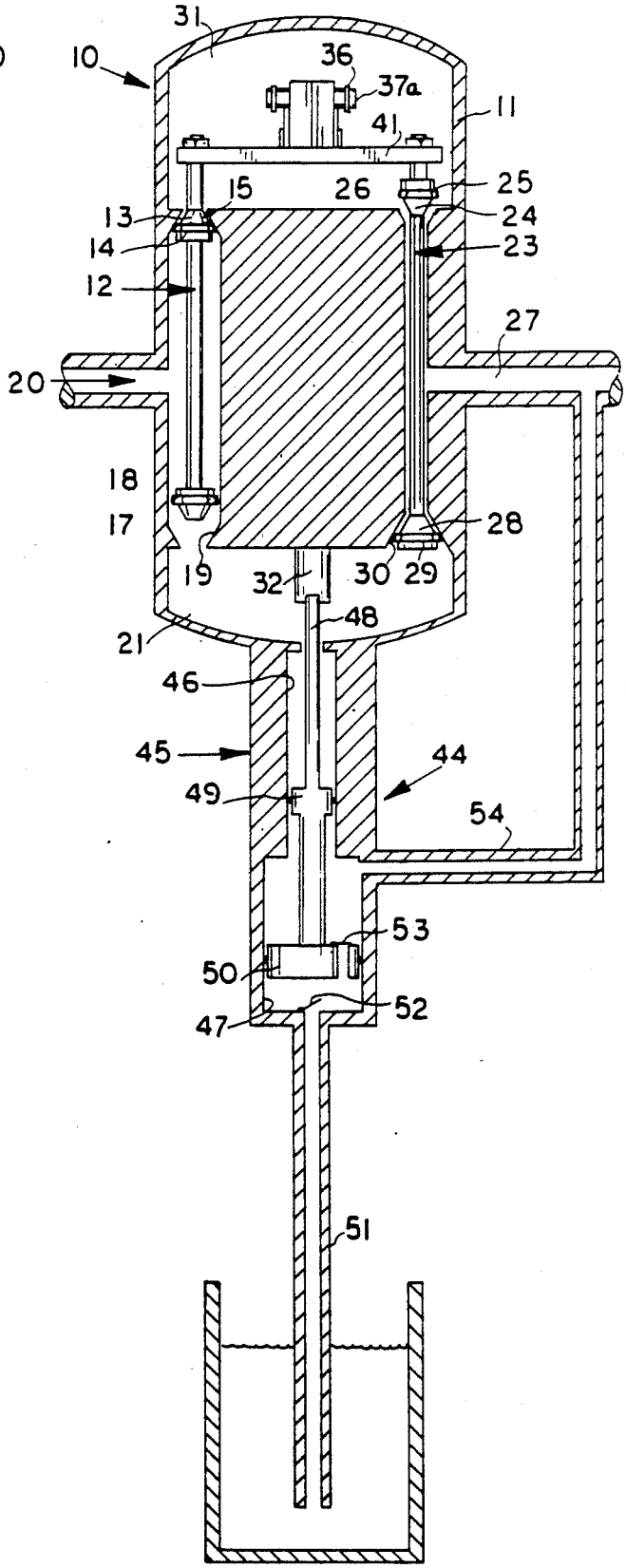
FIG. 2 is a cross sectional view taken along the lines 2—2 in FIG. 1.

Referring now to the drawings and Particularly FIGS. 1 and 2, the upstroke position of the pump 10 is shown. An inlet valve 12 is in its upper position in the pump body 11, in which position, a tapered valve seat 13, on the upper end of the valve 12, carrying an "o-ring" 14 is seated against a tapered shoulder 15 formed in the pump body 11. A valve stem 16 connects the upper tapered valve seat 13 to a lower tapered valve seat 17, carrying an "o-ring" 18, which at this time is spaced from a tapered shoulder 19 formed in the pump body 11. Flowing water enters the pump body 10 through a inlet line 20 and flows downwardly past the lower valve seat 17 and tapered shoulder 19 to fill a lower cavity 21 formed below a diaphragm piston 22, the periphery of which piston being secured in and sealed in the surrounding body portion 11 of the pump 10.

The water in cavity 21 forces the diaphragm piston 22 upwardly thereby forcing against any water above the piston from the downward stroke thereof, which will be hereinafter explained. The water above the diaphragm exits the pump body 11 through the upper end of an outlet valve 23. The upper end of the outlet valve 23 has a tapered shoulder 24 thereon carrying an "o-ring" 25 thereon, which at this time is spaced from a tapered valve seat 26, thereby allowing water to flow therepast and out though the outlet line 27. During the upstroke, the lower end of the outlet valve 23 has a tapered shoulder 28 thereon carring an "o-ring" 29 which at this time is seated against a tapered shoulder 30 formed in the pump body 11 thereby blocking the outlet line from any water entering the pump 10 through the inlet line 20 and present in the cavity 21. The outlet line 27 thereby drains the cavity 31 above the diaphragm piston 22 during the upstroke of the piston 22.

The diaphragm piston 22 has rigidly secured in the center thereof a vertically extending piston rod 32, which is mounted for vertical reciprocal movement in the pump body 11. As seen in FIG. 1, at the upper end of the piston rod 32 is pivotally secured the left end of a first linkage rod 33 by a pivot pin 34. Intermediate the ends of the linkage rod 33, the latter is pivotally mounted to the pump body 11 by a pivot pin 35. The right end of the linkage rod 33 is secured to the left end of a spring in the form of an "o-ring" 36. The right end of the o-ring 36 is secured to the upper end of a second linkage rod 38, by a pivot pin **37*a*, while the left end of the linkage rod 38 is pivotally mounted to the pump body 11 by a pivot pin 39**.

The pivot pin **37*a* is mounted in a slot 40 formed in a valve bridge 41. The valve bridge 41 is secured to and joins the upper ends of valves 12 and 23. When the diaphragm piston 22** moves toward its upper position, from the position shown in FIG. 1 no immediate movement of the valve bridge 41 takes place, but when the piston 22 moves to its upper position, the linkage 33 and 38 joined by the spring o-ring 36 goes over-center and with a snap action takes the position shown in FIG. 3 thereby rapidly reversing the positions of the valves 12 and 23. Prior to going over-center the linkage 33 and 38 do not cause movement of the valves 12 and 23. Similarly, as seen in FIGS. 3 and 4, the over-center linkage 33 and 38 do not cause movement of the valves 12 and 23 on the down stroke until the piston 22 reaches its downward position.

Figure 3:
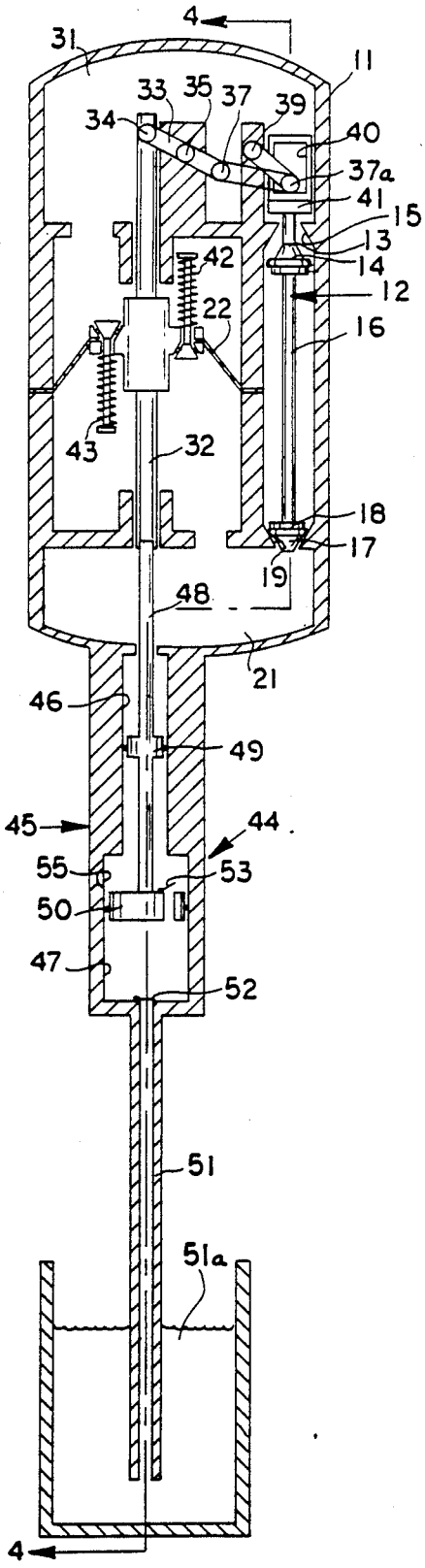
FIG. 3 is a view in longitudinal section of a device according to the invention in another operative position.
Figure 4:
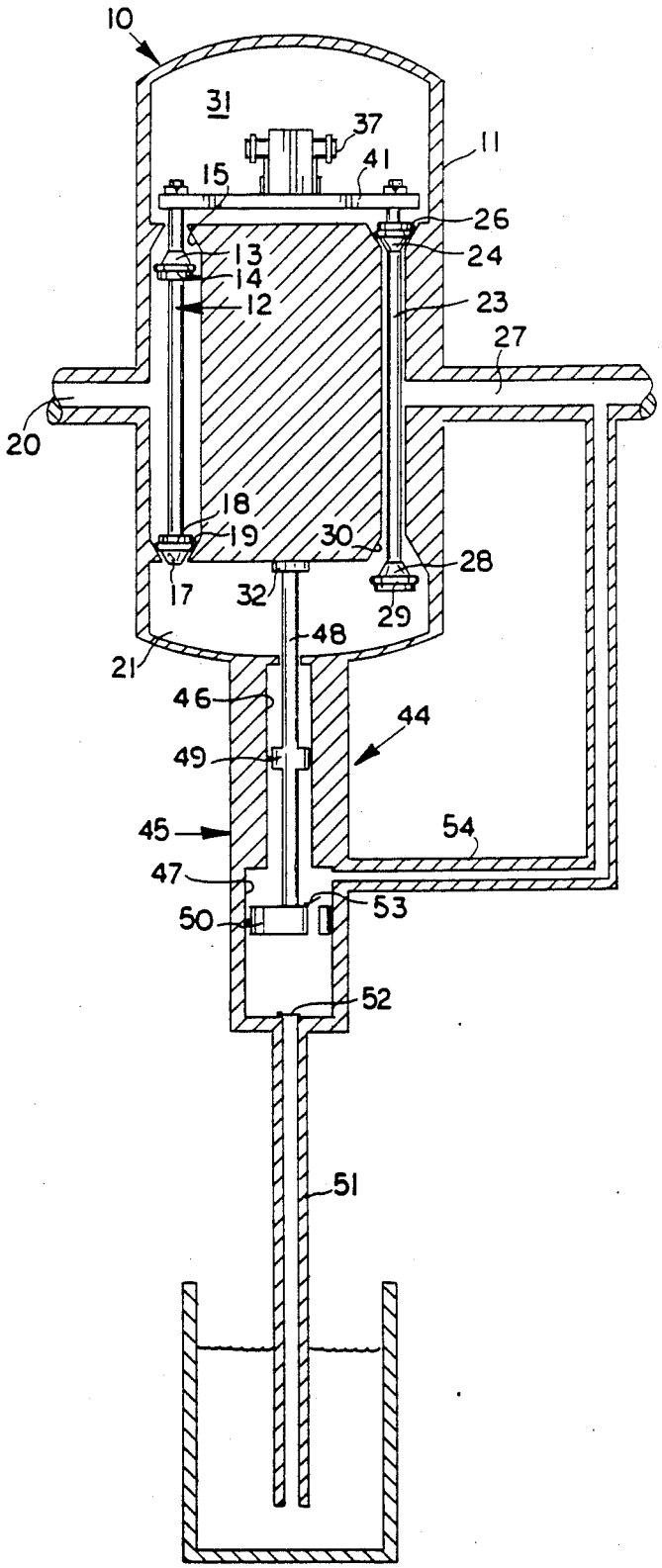
FIG. 4 is a cross sectional view taken along the lines 4—4 in FIG. 3.

Referring now to FIGS. 3 and 4, the downstroke position of the piston 22 is shown. The inlet valve 12 is in its lower position and its valve slot 13 and o-ring 14 are spaced from the shoulder 15. The lower valve seat 17 and its o-ring 18 are seated against the tapered shoulder 19. Flowing water enters the pump body 10 through inlet line 20 and flows upwardly past the valve seat 13 and tapered shoulder 15 to fill the upper cavity 31 formed above diaphragm 22 thereby forcing diaphragm 22 downwardly and forcing any water in cavity 22 out past the lower open end of valve 23 and out of the pump body through line 27.

Since the piston 22 only causes movement of the valve 12 and 23 through the action of the over center linkage 33 and 38, if the joining o-ring 36 breaks, the diaphragm piston 22 will move to its extreme up or down position depending if the inlet water is forcing it to its up stroke or downstroke. The direction of the water flow cannot change from one side of the piston 22 to the other, so the piston stops its up and down movement and water flow from the inlet line 20 to the outlet line 27 stops, since the water coming into either the upper or lower chamber is trapped and cannot flow through. This stopping of water can result in serious problems such as the shut off of drinking water to livestock. To prevent this shut off of water flow when the unit has stopped operation due to a failure, by pass valves have been supplied in the diaphragm piston. The valves are spring loaded so that during normal operation they remain closed but when the piston moves to its extreme position after a failure, however, these valves push against the pump body 11 and are forced open allowing water to pass through the piston and out the outlet.

More particularly, as seen in FIG. 1 a pair of by pass valves 42 and 43 are seen which are spring loaded closed. When the diaphragm piston 22 moves farther up from its position shown in FIG. 3, the top of valve 42 will strike the pump body 11 thereby forcing the valve 42 open and allowing water to flow through the piston 22 to fill both chambers 21 and 31 and out of chamber 31 past valve 23 which is now open. Contrarily, if the piston 22 moves farther down from its position shown in FIG. 1, then the bottom of valve 43 will strike the pump body 11 thereby forcing valve 43 open and allowing water to flow through the piston 22 to fill both chambers 21 and 31 and out of chamber 21 past valve 12 which is now open.

An additive pump 44 is disposed in an extension 45 of the pump body 11. The extension has an upper bore 46 which is coaxial with and one-half the cross sectional area of a lower bore 47. A piston rod 48 connects to the lower end of piston rod 32 and extends in a sliding and sealing relationship through the lower end of chamber 21. The piston rod 48 has an upper piston 49 in bore 46 and a lower piston 50 in bore 47 with the piston 49 having one-half the area of piston 50. A supply line 51 for additive fluid 51*a* connects to the bottom of extension 45 and a check valve 52 is located at the junction. When piston 50 moves up, check valve 52 is opened and when piston 50 moves down, check valve 52 closes. Piston 50 has a check valve 53 therethrough and when piston 50 moves upwardly, valve 53 closes, and when piston 50 moves downwardly, valve 53 opens.

As the pump piston rods 32 and 48 move up, a quantity of additive fluid is drawn through check valve 52 and into the bore 47 below piston 50 as shown in FIGS. 1 and 2. The quantity of fluid is equal to twice the amount of fluid which is desired to be injected into the quantity of water moving through the chambers 21 and 31 and out through line 27. An additive line 54 joins the bores 46 and 47 to the outlet line 27 and is connected to the extension 45 at the junction of the bores 46 and 47.

As the piston rods 32 and 48 are pushed down, check valve 52 closes and additive fluid is forced up through check valve 53 into the chamber between pistons 49 and 50. Piston 49 is one-half the area of piston 50 so that the chamber between the pistons 49 and 50 will only contain one-half the volume of additive being forced into it from the chamber below piston 50. The other one-half of this volume is forced out through line 54 to the outlet line 27. When the pump pistons 32 and 48 are pulled up again, check valve 53 closes, a quantity of additive fluid is drawn up into the chamber below the piston 50, and the remainder of the one-half volume between pistons 50 and 49 is forced out through line 54. By matching the volume of water required to move the diaphragm piston 22 with the volume of the additive fluid drawn up and inserted by the pistons 49 and 50, a given ratio of additive to water will be maintained.

In order to prime the additive pump, and referring to FIGS. 1 and 3, a small indentation 55 is formed in the wall of the lower bore 47 intermediate the ends thereof. As the piston 50 moves across the indentation 55 at the top of the stroke, additive liquid leaks around the seal and fills up the cavity below the piston thus priming the additive pump.

Although the above description relates to a presently preferred embodiment, numerous modifications can be made therein without departing from the spirit of the invention as defined in the following claims:

What is claimed is:

1. A proportioning pump for liquid additive metering comprising, a) a pump body, b) a diaphragm piston in said body and sealed about the periphery thereof, c) a first liquid for passing through said pump body, d) inlet and outlet valves and lines for passing said first liquid through said pump body, e) a piston rod movable with said piston and having an extension thereon, f) an additive liquid, g) a pair of additive pistons secured to the lower end of said extension for pumping said additive liquid to said first liquid external of said pump body, (h) by pass valves in said diaphragm piston to allow the by pass of said first liquid therethrough in the event said diaphragm piston travels beyond its normal position, (i) and indentation means in said pump body adjacent one piston of said pair of additive piston for allowing a leaking of priming fluid to said additive pistons.

2. A proportioning pump for liquid additive metering comprising, (a) a housing (b) a diaphragm piston mounted in said housing with the periphery thereof sealing and secured to said housing, (c) a pair of valves in said housing, (d) a piston rod carried by said diaphragm piston and connected by an overcenter spring loaded linkage to said pair of valves, (e) an inlet line into said housing (f) an outlet line out of said housing, (g) said pair of valves controlling the flow of liquid around said diaphragm piston and from said inlet to said outlet valves, (h) a piston rod extension, (i) a chamber in said homing receiving said rod extension, (j) said rod extension having a pair of additive pistons thereon with the upper of said pistons having one half the area of the lower of said pistons, (k) an additive inlet line and an additive fluid therein, (l) said additive pistons moving in unison with said diaphragm piston and pumping said additive fluid from said additive inlet line to said outlet line from said housing, (m) by pass valve means in said diaphragm piston to allow the by pass of liquid therethrough in the event the diaphragm piston travels beyond its normal position, (n) and indentation means in the chamber in said housing adjacent one of said additive pistons for allowing a leaking of priming fluid to said additive pistons.

* * * * *